United States Patent [19]

Baillie et al.

[11] Patent Number: 4,600,410

[45] Date of Patent: Jul. 15, 1986

[54] PROCESS AND APPARATUS FOR SEPARATING PARTICULATE MATTER FROM A GASEOUS MEDIUM

[75] Inventors: Lloyd A. Baillie, Homewood, Ill.; Amy L. Ryder, Munster, Ind.

[73] Assignee: Atlantic Richfield Company, Los Angeles, Calif.

[21] Appl. No.: 683,523

[22] Filed: Dec. 19, 1984

[51] Int. Cl.[4] ..... B04C 5/103

[52] U.S. Cl. ..... 55/1; 55/399; 55/459 R; 209/144

[58] Field of Search ..... 209/144, 211; 55/459 R, 55/1, 459 B, 459 C, 392, 398, 435, 426, 399; 210/512.1, 787, 788

[56] References Cited

U.S. PATENT DOCUMENTS

| | | | |
|---|---|---|---|
| 710,605 | 9/1902 | Osborne et al. | 55/459 R X |
| 2,010,128 | 8/1935 | Arnold | 209/144 |
| 2,364,405 | 12/1944 | Trimbey et al. | 210/512.1 X |
| 3,566,582 | 3/1971 | Yankura | 55/238 X |
| 4,004,615 | 1/1977 | Stern et al. | 55/435 X |
| 4,203,961 | 5/1980 | Cowley | 55/459 B X |

FOREIGN PATENT DOCUMENTS

| | | | |
|---|---|---|---|
| 365778 | 1/1932 | United Kingdom | 55/392 |

*Primary Examiner*—S. Leon Bashore
*Assistant Examiner*—Thomas M. Lithgow
*Attorney, Agent, or Firm*—Donald L. Traut

[57] ABSTRACT

A process and an apparatus are disclosed for separating particulate matter from a contaminated gaseous medium containing the particulate matter, including the steps of passing the contaminated gaseous medium through a swirl-inducing zone to form a swirling-contaminated gaseous medium; introducing the swirling-contaminated gaseous medium into a cyclonic separation zone via an introduction zone to separate at least a portion of the particulate matter from the swirling-contaminated gaseous medium and to form a layer of particulate matter on the inner surface of a wall defining the periphery of the separation zone; deflecting the layer of particulate matter below the introduction zone; removing the gaseous product from the separation zone through an exhaust flow zone disposed radially inward from the swirl-inducing zone; and removing the particulate matter from a lower region of the separation zone.

5 Claims, 2 Drawing Figures

PROCESS AND APPARATUS FOR SEPARATING PARTICULATE MATTER FROM A GASEOUS MEDIUM

BACKGROUND OF THE INVENTION

Field of the Invention

The present invention relates to a process and an apparatus for separating particulate matter from a contaminated gaseous medium containing the particulate matter.

Processes for separating particulate matter from a contaminated gaseous medium are well known. In one such process, the contaminated gaseous medium containing the particulate matter is passed through a swirl-inducing zone. The resulting swirling-contaminated gaseous medium is thereafter introduced into a cyclonic separation zone adjacent to the inner surface of the swirl-inducing zone to (1) separate at least a portion of the particulate matter from the swirling-contaminated gaseous medium and (2) form a gaseous product which is at least partially depleted of particulate matter. The gaseous product is thereafter removed from the separation zone through an exhaust flow zone disposed radially inward from the swirl-inducing zone.

In U.S. Pat. No. 4,212,653, an improved process for increasing separation efficiency is disclosed. In this process, a substantially contaminant-free gaseous medium is passed through an additional swirl-inducing zone to form a coswirling mass thereof, and the coswirling gaseous medium is introduced into the separation zone through an introduction zone disposed radially inward from the swirling-contaminated gaseous medium and radially outward from the exhaust flow zone. The purpose of the introduction of the coswirling substantially contaminant-free gaseous medium is to shield the contaminated medium from the exhaust flow zone and the eddy currents developed upon introduction of the contaminant-laden medium.

However, the two processes described above have not been entirely satisfactory from the standpoint of separation efficiency. It has now been found that the substantial increases in separation efficiency of the above-described separation processes are obtained by the practice of this invention, which provides an improvement to the processes.

SUMMARY OF THE INVENTION

In this invention, a process is disclosed for separating particulate matter from a contaminated gaseous medium containing the particulate matter, including the steps of:

(a) passing the contaminated gaseous medium through a swirl-inducing zone to form a swirling-contaminated gaseous medium;

(b) introducing the swirling-contaminated gaseous medium into a cyclonic separation zone via an introduction zone adjacent to the inner surface of a wall defining the periphery of the separation zone to separate at least a portion of the particulate matter from the swirling-contaminated gaseous medium and to form a layer of particulate matter on the inner surface of the wall, forming a gaseous product which is at least partially depleted of particulate matter;

(c) deflecting the layer of particulate matter below the introduction zone;

(d) removing the gaseous product from the separation zone through an exhaust flow zone disposed radially inward from the swirl-inducing zone; and (e) removing the particulate matter through a particulate removal zone below the separation zone.

Additionally, this invention includes an apparatus for separating particulate matter from a contaminated gaseous medium containing the particulate matter comprising:

(a) a means for swirling the contaminated gaseous medium;

(b) a means for introducing the swirling-contaminated gaseous medium into a cyclonic separation zone via an introduction zone adjacent to the inner surface of a wall defining the periphery of the separation zone to separate at least a portion of the particulate matter from the swirling-contaminated gaseous medium and to form a layer of particulate matter on the inner surface of the wall;

(c) a means for deflecting the layer of particulate matter below the introduction zone;

(d) a means for removing a substantially contaminant-free gaseous product from the separation zone; and (e) a means for removing the separated gaseous product from the particulate matter in the separation zone.

Although it is not intended to be bound by any theory of operation, it is believed that the increased separation efficiency obtained by the improvement of this invention is effected by diverting the particulate matter previously separated from the swirling-contaminated gaseous medium to below the introduction zone for the introduction of additional contaminated gaseous medium. Under this theory, this diversion action operates to substantially reduce the reentrainment of the particulate matter in the swirling gaseous medium and avoids the necessity of directing the contaminated gaseous medium in a tangentially downward direction to avoid the intersection of the incoming stream of contaminated gaseous medium and the previously separated particulate matter. This downward direction causes undesirable turbulence within the separation zone.

BRIEF DESCRIPTION OF THE DRAWINGS

This invention will be better understood by the following detailed description taken in conjunction with the accompanying Figures, wherein like numerals refer to similar elements throughout.

DETAILED DESCRIPTION OF THE INVENTION

Figure 1:
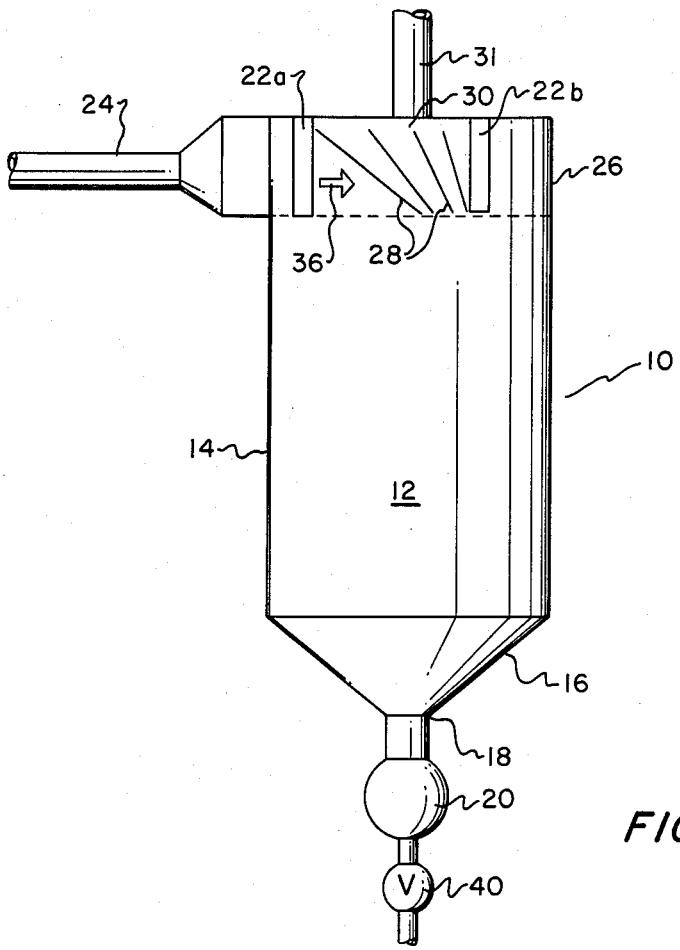
FIG. 1 is an elevational view in somewhat schematic form of a cyclonic separator suitable for carrying out the process of this invention.

Referring now to FIG. 1, there is shown a cyclonic separator 10 which includes a vertically oriented separation zone 12 defined peripherally by a composite conical/cylindrical wall, including cylindrical wall portion 14 defining the upper region of the separation zone 12 and a conical wall portion 16 defining the lower region of the separation zone 12. At the bottom of the separation zone 12, an opening 18 is formed in the minimum-diameter region of the separation zone 12. A dust collection hopper 20 is joined to the separation zone 12 at the opening 18 thereof.

An introduction zone 26 is formed in the upper region of the separation zone 12 and is generally bounded by the cylindrical wall portion 14 of the separation zone 12. Introduction zone 26 includes inlets 22*a*, 22*b*, etc., for the introduction of the swirling-contaminated gaseous medium. The inlets 22 are fed from conduits 24, which are formed to cause the medium to swirl upon entrance into the separation zone 12. The inlets 22 introduce the swirling-contaminated gaseous medium into the separation zone 12 adjacent to the outer surface of the separation zone 12—this is the inner surface of the cylindrical wall portion 14. The clean gaseous medium exits the separation zone 12 via an axial exhaust conduit having an inlet portion 30 and a vertical, stack portion 31. Deflector vanes 28 are formed on the inner surface of the cylindrical wall portion 14 and are angled so as to deflect the particulate matter below the introduction zone 26. Within the separation chamber 12, the inner surface of the generally cylindrically upright wall portion 14 and the outer edge of the swirling turbulent region of the gaseous medium in the separation zone 12 define an annular zone 34. In the annular zone 34, the particulate matter moves along the wall at velocities much less than those velocities of the gaseous medium in the swirling turbulent region.

Figure 2:
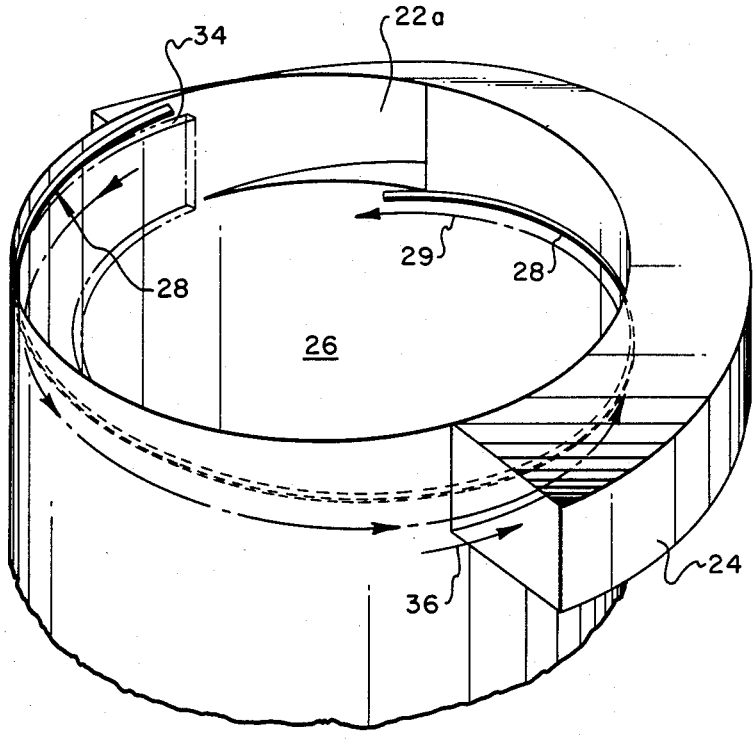
FIG. 2 is an inside view of a portion of a separator in accordance with the invention showing the introduction zone and the top part of the separation zone.

In carrying out the present process for separating particulate matter from dirty gas containing particulate matter therein, the dirty gas is admitted preferably in a continuous manner through the conduits 24 into the inlet 22*a*. From the swirl-inducing zone, the dirty gas is admitted to the introduction zone 26 under pressure, as by a blower if needed, and flows in a circumferential or tangential direction, as shown in FIG. 1 by the heavy arrow 36 which is superimposed on the introduction zone 26. The swirling dirty gas, which is swirling in a counterclockwise direction, viewing FIG. 2, develops centrifugal forces which move the particulate matter contained in the dirty gas to the annular zone 34, where it contacts or flows very close to the cylindrical wall portion 14 of the separation zone 12. The separated particles generally flow down the walls of the chamber in a helical pattern and pass through the opening 18 and ultimately accumulate in the dust collection hopper 20. However, in normal operation, the flow of separated particles crosses over an inlet 22*a* of the introduction zone 26. This crossing-over of separated particles reentrains at least a portion of the particles, thus decreasing operating efficiency. In the process of this invention, as shown in FIG. 2, the deflector vanes 28 cause the separated particles, shown by the arrow 29, to be directed beneath the inlets 22 such that the particles are not reentrained in the swirling-contaminated gaseous medium.

The accumulation of particles held in the dust collection hopper 20 may be discharged through a discharge line having a valve 40 therein by means well known in the art. The upwardly flowing gas, from which a major portion of the particulate matter has been removed, exits the separation zone through the axial exhaust conduit 30.

In the introduction zone 26, the contaminant-containing gaseous medium is introduced in a tangential manner which is in a plane substantially perpendicular to the axis of the swirling gases. This results in increased efficiency of the separation process (i.e., the amount of particulate matter in the lower region of the separation zone 12 is not reentrained by misdirected inlet-contaminated gaseous medium).

It is critical to this invention that the deflector vanes 28 be properly sized. The vanes should deflect the particulate matter to a region below the inlets 22*a* and 22*b*. However, they should not be of such thickness as to cause the swirling gases to be deflected to the lower region of the separation zone 12. The deflector vanes 28 should extend radially inward from the wall about the thickness of the laminar flow region found in a particular cyclone apparatus. The sizing of the deflector vanes 28 will depend upon the diameter of the cyclone apparatus, the rate of introduction of the gaseous medium, particulate loading, etc. In a typical cyclone separator operation, the vanes are preferably extended radially inward from the wall of the separation zone between about $\frac{1}{4}$ and about $\frac{3}{4}$ of an inch.

The deflector means may comprise a plurality of vanes staggered around the cylindrical wall portion 14 as indicated in FIG. 1. Preferably, the initial vane closer to an inlet 22 will be at a lesser angle to the direction of flow than subsequent vanes, which will be at a greater angle. The upstream radial edge of the deflector vanes 28 is preferably formed perpendicular to the direction of the swirling-contaminated gaseous medium. The downstream edge is preferably parallel to the flow of the swirling-contaminated gaseous medium. Preferably, the upstream edge of each vane is formed with wear-resistant face, not shown.

It is not necessary for the cyclone apparatus to have a plurality of inlets. The apparatus herein described may be made using well-known construction techniques for making cyclone separators. The particular materials employed will be selected to best accommodate the cost of construction and durability required for a given application. In general, the various components of the apparatus may be of steel. The best mode contemplated, at the time of executing this patent application, for carrying out the present process has been set forth in the foregoing description. It is to be understood that the foregoing detailed description is given merely by way of illustration and numerous modifications may be made therein without departing from the spirit or scope of this invention.

What is claimed is:

1. A process for separating particulate matter from a contaminated gaseous medium containing the particulate matter comprising:

(a) passing said contaminated gaseous medium through means forming a gas inlet to a swirl-inducing zone and through said swirl-inducing zone to form a flow of swirling-contaminated gaseous medium;

(b) introducing said swirling-contaminated gaseous medium into a cyclonic separation zone via an introduction zone adjacent to the inner surface of a wall defining the periphery of said separation zone to separate at least a portion of said particulate matter from said swirling-contaminated gaseous medium to form a laminar flow region extending radially inward from said wall including a layer of said particulate matter on said inner surface of said wall, and to form a gaseous product which is at least partially depleted of said particulate matter;

(c) deflecting substantially only said flow of gaseous medium in said laminar flow region and including said layer of particulate matter below said gas inlet and said introduction zone;

(d) removing said gaseous product from said separation zone through an exhaust flow zone disposed radially inward from said swirl-inducing zone; and (e) removing said particulate matter through a particulate removal zone below said separation zone.

2. The process of claim 1 wherein said deflecting step comprises employing vane means extending radially inward from said wall of said separation zone a distance corresponding to said laminar flow region.

3. The process of claim 2 wherein said vane means extend radially inward from said wall of said separation zone between about $\frac{1}{4}$ and $\frac{3}{4}$ of an inch.

4. An apparatus for separating particulate matter from a contaminated gaseous medium containing said particulate matter comprising:

(a) means including a generally cylindrical wall and means forming a gas inlet opening in said wall for swirling said contaminated gaseous medium;

(b) means for introducing said swirling-contaminated gaseous medium into a cyclonic separation zone in said apparatus via an introduction zone adjacent to said wall to separate at least a portion of said particulate matter from said swirling-contaminated gaseous medium and to form a laminar flow region including a layer of said particulate matter extending radially inward with respect to a central axis of said wall from said inner surface of said wall;

(c) vane means extending radially inward from said wall to a point about the radial thickness of said laminar flow region and circumferentially from a point adjacent said inlet to a point below said inlet for deflecting said layer of particulate matter below said introduction zone;

(d) means for removing a substantially contaminant-free gaseous product from said separation zone; and (e) means for removing said particulate matter from said separation zone.

5. The apparatus of claim 4 wherein said vane means extend radially inward from said wall of said separation zone between about $\frac{1}{4}$ and about $\frac{3}{4}$ of an inch.

* * * * *